US005622022A

United States Patent [19]

Haisch

[11] Patent Number: 5,622,022

[45] Date of Patent: Apr. 22, 1997

[54] ARCHITECTURAL TRUSS CONNECTOR

[76] Inventor: Douglas C. Haisch, 1800 S. Barney St., Anderson, Calif. 96007

[21] Appl. No.: 453,256

[22] Filed: May 30, 1995

[51] Int. Cl.[6] ..... E04C 3/12; E04B 1/38

[52] U.S. Cl. ..... 52/713; 52/655.1; 52/696; 52/654.1

[58] Field of Search ..... 52/655.1, 656.1, 52/696, 691, 690, 639, 643, 712, 713, 654.1, 656.9; 903/283, 384, 403, 405.1

[56] References Cited

U.S. PATENT DOCUMENTS 2,902,951 9/1959 Maag .
3,333,875 8/1967 Tracy .
3,537,224 11/1970 Troutner .
3,849,961 11/1974 Gwynne .
3,867,803 2/1975 Platt .
3,946,532 3/1976 Gilb .
3,985,459 10/1976 Gilb .
4,077,176 3/1978 Bauer .
4,275,537 6/1981 Pinson .
4,414,787 11/1983 Kappen .

*Primary Examiner*—Robert Canfield
*Attorney, Agent, or Firm*—Bielen, Peterson & Lampe

[57] ABSTRACT

An architectural truss having a connector utilizing first, second, third, and fourth plate structures which lie adjacent three chords. The first plate structure engages an outer first chord while the second plate structure engages the outer first chord and a central second chord. A third plate structure engages the central second chord and a third outer chord. A fourth plate structure engages the third outer chord. Each plate structure resists movement relative to an adjacent chord under shear stress. An interconnecting member engages and holds each of the plate structures. The central second chord may extend outwardly from the first and third chords at an angle to form a corner of a triangular structure constituting a portion of a truss.

11 Claims, 2 Drawing Sheets

ARCHITECTURAL TRUSS CONNECTOR

BACKGROUND OF THE INVENTION

The present invention relates to a novel and useful architectural truss connector.

Trusses have often been used in structures in place of beams of uniform section. For spans above 50 to 70 feet, trusses, using metallic members, are usually more economical. However, below these limits the economy of a truss is not definitely marked and depends greatly on the strength gain obtained using a truss compared to the cost of obtaining the same.

In the past, greater strength in a building frame has been achieved by the use of brackets or braces. For example, U.S. Pat. Nos. 3,333,875; 3,849,961; and 4,275,537 describe brackets, clips, and tension members which are used in structural assemblies that may include trusses.

U.S. Pat. Nos. 3,985,459; 3,946,532; and 4,077,176 show truss joint connector assemblies in which toothed plates are used in combination with metallic tubular members serving as structural web portions of trusses and the like.

U.S. Pat. Nos. 2,902,951; 3,537,224; 3,867,803; and 4,414,787 describe flat and roof truss structures which employ braces, case connected web members, and plates for providing load transfer surfaces.

None of the prior art systems for architectural trusses show connectors to permit the use of wooden chord and web members, resulting in a truss of greatly increased strength and which may be used in relatively small structures.

SUMMARY OF THE INVENTION

The present invention relates to a novel and useful architectural truss connector for uniting a multiplicity of chords and webs therein.

The connector of the present invention utilizes a first, second, and third chords. The first and second chords generally extend parallel to one another while the second chord would extend outwardly from the connector at a particular pitch or angle. The connector includes first and second plate means which straddle or sandwich the first outer chord. Third plate means and the second plate means sandwich the central second chord. The third plate means and fourth plate means sandwich the third outer chord. Each of the plate means may include a surface having projections or teeth which extend into the chords to resist movement of each plate means relative to each chord under shear stress. In this regard, each of the chords may be composed of wood or similar material. Each of the plates are preferably metallic in structure. The second and third plate means may take the form of a pair of plates in side-by-side configuration.

Interconnecting means is also employed in the present invention for engaging and arresting movement relative to the first, second, third, and fourth plate means. Such interconnecting means may take the form of a connecting bolt which extends through each of the chords and all of the straddled plates, as heretofore described. Also, fastening means may further individually compress the first, second, third, and fourth plate means and the three chords.

In certain embodiments of the present invention, a fourth central chord would be used and lie adjacent the central second chord in the connector system of the present invention. The second and third plate means would sandwich the central second and fourth chords, in this position. In essence, the load supported by the truss is transferred from the wooden chord members to the metallic plates, which are interconnected. This greatly adds to the overall strength of the truss structure.

It may be apparent that a novel and useful architectural connector has been described.

It is therefore an object of the present invention to provide an architectural truss connector which is capable of being constructed with wooden chords and webs and possesses a load bearing strength far in excess of a wooden truss without the connector of the present invention.

Another object of the present invention is to provide an architectural truss connector which allows the assemblage of an architectural truss in a pre-fabricated configuration for use in a structure.

Another object of the present invention is to provide an architectural truss connector which permits the easy assemblage of an architectural truss on the building site which is stronger than an architectural truss built of wood, chord, and web members.

Yet another object of the present invention is to provide a truss structure which is economical to use in relatively small structures.

The invention possesses other objects and advantages especially as concerns particular characteristics and features thereof which will become apparent as the specification continues.

Figure 1:
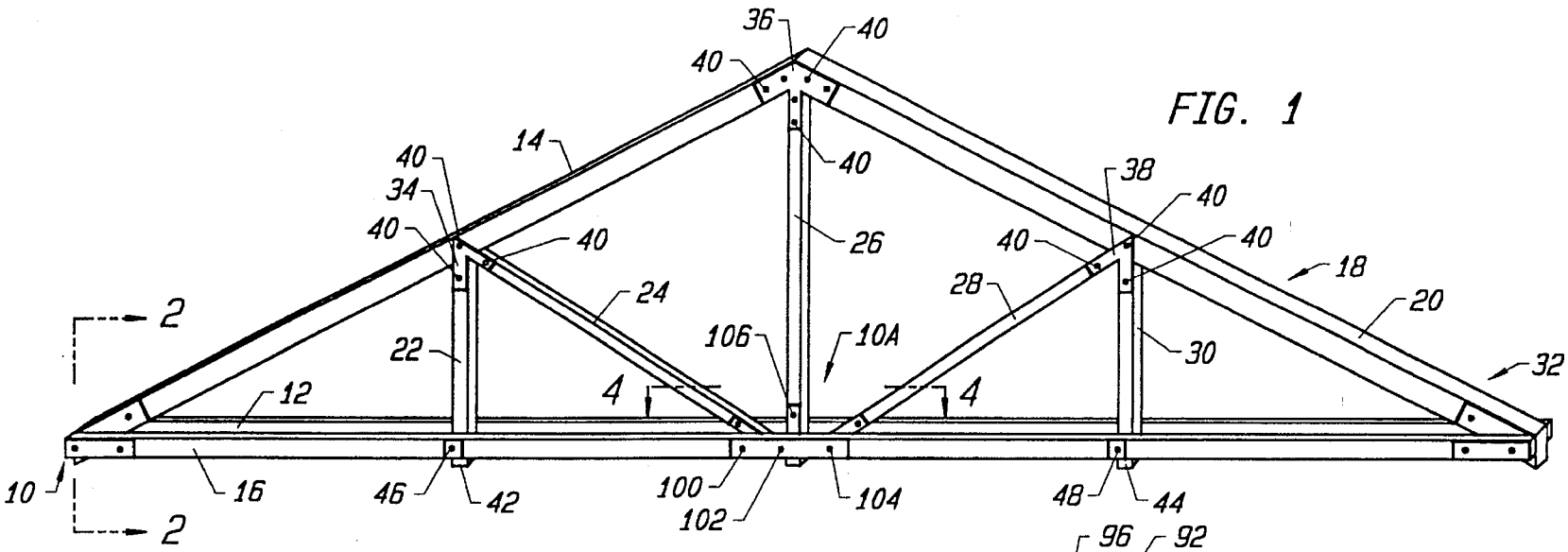
FIG. 1 is a top right perspective view of an architectural truss employing the connector of the present invention.

For a better understanding of the invention reference is made to the following detailed description of the preferred embodiments which should be taken in conjunction with the prior described drawings,

DETAILED DESCRIPTION OF THE PREFERRED EMBODIMENTS

Various aspects of the present invention will evolve from the following detailed description of the preferred embodiments thereof which should be referenced to the prior described drawings.

The architectural truss connector 10 of the present invention is used in conjunction with at least three chords. For example, chord 12, 14, and 16, FIG. 1 would suffice in this regard. As may be observed in FIG. 2, chords 12 and 16 are typically constructed of wood and lie outside central chord 14. Central chord 14 may also have a larger transverse dimension than chords 12 and 16. Chords 12, 14, and 16 may comprise a portion of truss structure 18, FIG. 1, which further includes chord 20 and web members 22, 24, 26, 28, and 30. A connector 32 is also employed and is the mirror image of connector 10. Connector 10A at the central portion of truss 18 is deemed to be part of the present invention and a variation of connector 10, both of which will be described hereinafter.

Pairs of plates 34, 36, and 38 are depicted singularly in FIG. 1. That is to say, plate 34, and another similar plate not shown, hold webs 22 and 24 to chord 14. First plate 36, and a similar rear plate, not shown, hold web 26 to chords 14 and 20. Further, front plate 38, and another rear plate, not shown, on the back side of chord 20 hold webs 28 and 30 to chord 20. Plurality of fasteners 40, such as nuts and bolts, fasten plates 34, 36, and 38 to the chord and web members as described above, in a conventional manner. Similarly, clips 42 and 44 fasten chords 12 and 16 to web 22 and web 30, respectively. Fasteners 46 and 48 hold clips 42 and 44, respectively in the manner above described. Fasteners 46 and 48 may again take the form of conventional nut and bolt structures.

Figure 2:
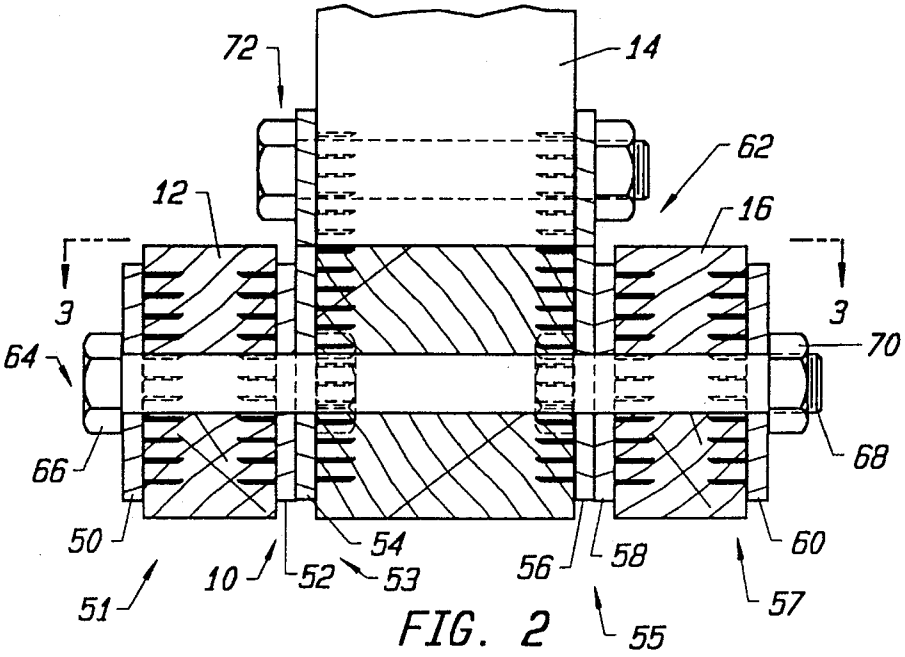
FIG. 2 is a sectional view taken along line 2—2 of FIG. 1.

Turning to FIG. 2, it may be observed that connector 10 is depicted in section. Connector 10 includes first and second plates 50 and 52 which straddle or sandwich chord 12. Second and third plates 54 and 56 sandwich chord 14. Finally, plates 58 and 60 sandwich chord 16. Plate 50 forms first plate means 51 while plates 52 and 54 constitute second plate means 53. Plates 56 and 58 form third plate means 55, while plate 60 is considered to be fourth plate means 57. It may be apparent that plates 52 and 54, as well as plates 56 and 58, lie adjacent one another in this arrangement. In the embodiment depicted in FIG. 2, plates 52 and 54, as well as plates 56 and 58, engage one another. Plates 54 and 56 extend outwardly at an angle, following the angle of upwardly extending chord 14. Plates 50, 52, 54, 56, 58, and 60 are shown to possess a plurality of teeth or projections 62 that are capable of penetrating chords 12, 14, and 16, which are illustrated as being fashioned of wood. Other projections such as edges, nails, anchors, and the like may serve this function. Thus, each plate means 51, 53, 55, and 57 resists movement relative to shear stress exerted on engaged chords 12, 14, and 16. In other words, such shear force stabilization takes place through plate means 51 and chord 12, plate means 53 and chords 12 and 14, plate means 55 and chords 14 and 16, and plate means 57 and chord 16. Of course, chords 12, 14, and 16 may be composed of other materials which are usable with toothed plates 50, 52, 54, 56, 58, and 60, such as laminated wood, plastic, composite material, and the like.

Figure 3:
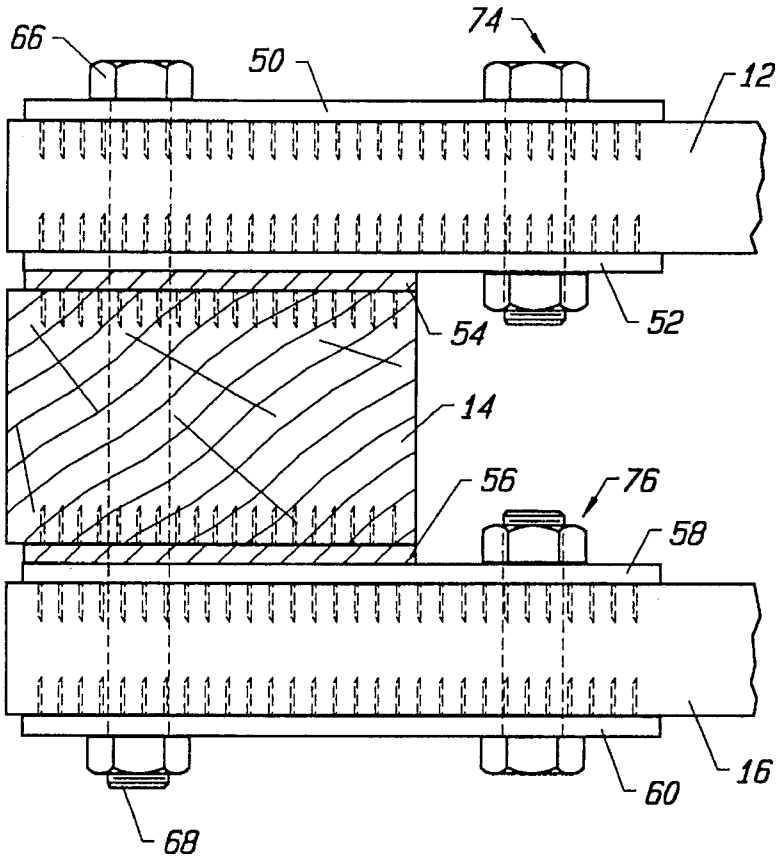
FIG. 3 is a sectional view taken along line 3—3 of FIG. 2.

Interconnecting means 64 is also shown in FIG. 2 for engaging and arresting movement between said first, second, third, and fourth plate means 51, 53, 55, and 57. Interconnecting means also holds chords 12, 14, and 16 and plates 50, 52, 54, 56, 58, and 60 in compression. Interconnecting means 64 takes the form of a bolt 66 having a threaded end portion 68 engageable by threaded nut 70. The tightening of nut 70 provides compressive force in the arrangement shown in FIG. 2. Plates 52 and 56 are held directly to chord 14 by nut and bolt fastening means 72. Referring to FIG. 3, it may be apparent that nut and bolt fastening means 74 compresses plates 50 and 52 against chord 12. Likewise, nut and bolt fastening means 76 forces plates 58 and 60 to chord 16. Thus, the bearing forces on truss structure 18 are transferred from the wooden chord members 12, 14, and 16 to the metallic plates 50, 52, 54, 56, 58, and 60 of plate means 51, 53, 55, and 57. With the substitution of chord 20 for chord 14, connector 32 is substantially identical to connector 10, except that connector 32 is a mirror image of connector 10.

Figure 4:
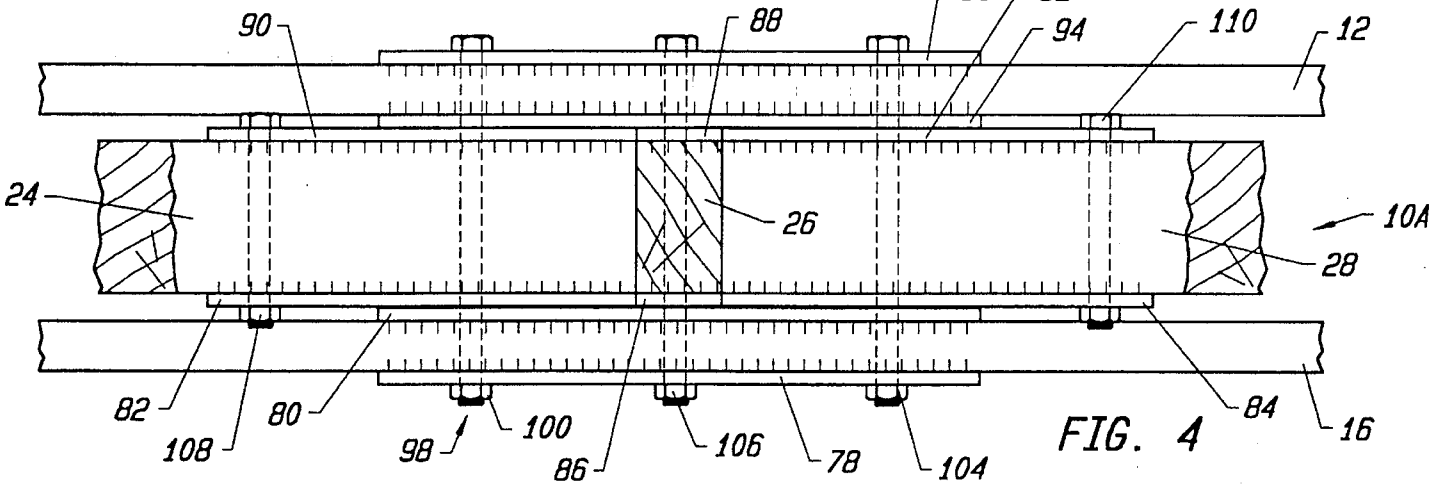
FIG. 4 is a sectional view taken along line 4—4 of FIG. 1.

With reference to FIG. 4, connector 10A is detailed. Connector 10A includes plates 78, 80, 82, 84, 86, 88, 90, 92, 94, and 96. Plates 78 and 80 straddle chord 16, while plates 94 and 96 sandwich chords 12. Plates 82, 84, 86, 88, 90, and 92 straddle or sandwich webs 24, 26, and 28. Plate 80 lies adjacent to and contacts plates 82, 86, and 84, while plate 94 lies adjacent to and contacts plates 88, 90, and 92. Interconnecting means 98, in the form of nut and bolt fasteners 100, 102, and 104, hold chords 12 and 16, webs 24, 26, and 28, and plates 78, 80, 82, 84, 86, 88, 90, 92, 94, and 96 together. Nut and bolt fastener 106 also extends upwardly along web 26 to fasten plates 86 and 88 thereto. In addition, nut and bolt fasteners 108 and 110 further hold plates 82 and 90 to web 24 and plates 84 and 92 to web 28, respectively. It may be observed that the combination of chords 12, 16 and 24 of connector 10A is substantially similar to the structure of connector 32, employing chords 12, 16 and 20. However, connector 10A varies in that web 26 and plates 86 and 88 have been added in the central portion. This addition may also be viewed as a variation of connection 10, focusing on the portion of connector 10A which holds chords 12 and 16 to web 28.

In operation, the truss structure is assembled according to FIGS. 1–3 using connectors 10 and 32 at the corners thereof. Plate means 51, 53, 55, and 57 of exemplary connector 10 receive the shear forces on chords 12, 14, and 16 and resist movement relative to the chords. Further, interconnecting means 64 engages each plate means 51, 53, 55, and 57 to arrest movement between each plate means. Connectors 32 and 10A operate in a similar manner. Connector 10A is employed to hold web members 24, 26, 28, to chords 12, 16, 14, and 20 as depicted in FIG. 4. Pairs of plates 34, 36, and 38 bind the web structure to the upper chords 14 and 20. Clips 42 and 44 connect vertical webs 22 and 30 to bottom chords 12 and 16, respectively. It has been found that the truss structure of the present invention through the use of connectors 10, 10A, and 32 and wooden chords is extremely strong and capable of use in smaller structure than previously have been used with truss structures geometrically similar to truss structure 18, employing all metal members.

The following examples is illustrative of the strength of the plate portions employed in the present invention, but is not deemed to limit the scope of the invention.

EXAMPLE 1

Ten 2×4×12 inch pieces of truss grade lumber were butt joined by a pair of toothed plates positioned on either side of the butt joint. The toothed plate consisted of a ¼ inch steel plate having a thin toothed plate welded thereto to form such a composite. The composite tooth plates were pressed fitted to the butt jointed 2×4 truss grade lumber members, moisture tested, and transported to the MTI testing laboratory in Redding, Calif. Moisture tests were again performed in the testing laboratory prior to tensile testing. Each of the ten samples was tensile tested using a Tinius Olsen universal testing machine at about 80,000 pounds plus or minus 100 pounds. The following table is a summary of the measurements and the ultimate tensile load achieved.

TABLE I

| Specimen Number | Initial Moisture at 7:45 a.m. | Final Moisture at 10 a.m. | Ultimate Tensile Load, lbs. |
|---|---|---|---|
| 1 | 22/22 | 26/26 | 14,600 |
| 2 | 22/22 | 25/25 | 13,100 |
| 3 | 22/23 | 26/25 | 13,000 |
| 4 | 22/24 | 25/25 | 12,300 |
| 5 | 23/23 | 25/24 | 13,500 |
| 6 | 25/23 | 26/25 | 12,500 |
| 7 | 26/23 | 25/25 | 12,400 |
| 8 | 24/25 | 26/25 | 12,600 |
| 9 | 28/24 | 31/24 | 12,500 |
| 10 | 24/31 | 24/31 | 14,500 |

TABLE I-continued

| Specimen Number | Initial Moisture at 7:45 a.m. | Final Moisture at 10 a.m. | Ultimate Tensile Load, lbs. |
|---|---|---|---|
| Mean: | 23.8/24 | 25.9/25.5 | 13,100 |
| Standard Deviation: | 2.04/2.62 | 1.91/2.01 | 848.5 |

Note: All failures occurred at the press plate to wood interface. It is believed that the tensile load at failure is approximately three times that found in a wooden truss member without the sandwiching plates used in this example.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An architectural truss connector for uniting an outer first, a central second and third outer chord, comprising:

a. first plate means adapted for engaging the outer first chord and for resisting movement relative to the outer first chord, upon the application of shear stress between the outer first chord and said finest plate means;

b. second plate means adapted for positioning between and engaging the outer first and central second chords, said second plate means adapted for resisting movement relative to the outer first and central second chords upon the application of shear stress between the outer first and central second chords and said second plate means;

c. third plate means adapted for positioning between and engaging the central second chord and the outer third chord, said third plate means adapted for resisting movement relative to the central second chord and the outer third chord upon the application of shear stress between the second chord and said third plate means;

d. fourth plate means adapted for engaging the outer third chord adapted for resisting movement relative to the outer third chord upon the application of shear stress between the outer third chord and said third plate means; and e. interconnecting means for engaging and arresting movement between said first, second, third, and fourth plate means.

2. The connector of claim 1 in which said second and third plate means each includes a pair of plates adjacent one another.

3. The connector of claim 2 in which said first and fourth plate means each comprises a single plate.

4. The connector of claim 3 in which at least one of said plates includes a plurality of teeth adapted for penetrating at least one of said chords.

5. The connector of claim 3 in which a plurality of said plates includes a plurality of teeth adapted for penetrating at least one of said chords.

6. The connector of claim 1 wherein said interconnecting means further comprises fastening means for holding said first, second, and third plate means in compression.

7. The connector of claim 2 in which each of said pair of plates of said second and third plate means includes one plate angularly oriented relative to another adjacent plate.

8. The connector of claim 3 in which a first plate of said first plate means, second and third plates of said second plate means fourth and fifth plates of said third plate means, and a sixth plate of said fourth plate means lie essentially parallel to each other.

9. The connector of claim 1 in which said interconnecting means is an elongated rigid member.

10. The connector of claim 1 in which said second and third plate means are further adapted for engaging a fourth chord for resisting movement between said second and third plate means and the fourth chord upon the application of shear stress between the fourth chord and said second and third plate means.

11. The connector of claim 9 in which said second and third plate means are further adapted for engaging a fifth chord to resist movement between said second and third plate means and the fifth chord, upon the application of shear stress between the fifth chord and said second and third plate means.

* * * * *